US008827083B2

(12) United States Patent
Doppstadt et al.

(10) Patent No.: US 8,827,083 B2
(45) Date of Patent: Sep. 9, 2014

(54) STAR SCREEN, IN PARTICULAR FOR A STAR SCREEN MACHINE

(75) Inventors: Johann Doppstadt, Velbert (DE); Horst Berger, Calbe (DE)

(73) Assignee: Doppstadt Familienholding GmbH, Valbert (DE)

( * ) Notice: Subject to any disclaimer, the term of this patent is extended or adjusted under 35 U.S.C. 154(b) by 514 days.

(21) Appl. No.: 13/141,397

(22) PCT Filed: Dec. 3, 2009

(86) PCT No.: PCT/EP2009/008634
§ 371 (c)(1),
(2), (4) Date: Aug. 29, 2011

(87) PCT Pub. No.: WO2010/072317
PCT Pub. Date: Jul. 1, 2010

(65) Prior Publication Data

US 2011/0303587 A1 Dec. 15, 2011

(30) Foreign Application Priority Data

Dec. 22, 2008 (DE) ..... 20 2008 016 913 U

(51) Int. Cl.
*B07C 5/12* (2006.01)
*B07B 1/15* (2006.01)
*B07B 1/50* (2006.01)

(52) U.S. Cl.
CPC .... *B07B 1/15* (2013.01); *B07B 1/50* (2013.01)
USPC ..... 209/672; 209/671; 209/673

(58) Field of Classification Search
USPC ..... 209/671, 672, 673
See application file for complete search history.

(56) References Cited

U.S. PATENT DOCUMENTS

| | | | | | |
|---|---|---|---|---|---|
| 2,880,870 | A * | 4/1959 | Colin | ..... | 209/269 |
| 3,392,114 | A * | 7/1968 | Delcellier | ..... | 210/712 |
| 5,847,273 | A * | 12/1998 | Zubragel | ..... | 73/149 |
| 6,296,124 | B1 * | 10/2001 | Zubragel | ..... | 209/672 |
| 7,005,077 | B1 * | 2/2006 | Brenner et al. | ..... | 210/770 |
| 2011/0303587 | A1 * | 12/2011 | Doppstadt et al. | ..... | 209/672 |

FOREIGN PATENT DOCUMENTS

| | | | | | |
|---|---|---|---|---|---|
| DE | 10 2007 042 518 | | 3/2009 | | |
| DE | 102007042518 | A1 * | 3/2009 | ..... | B07B 1/15 |
| EP | 1531013 | | 5/2005 | | |
| EP | 1531013 | A2 * | 5/2005 | ..... | B07B 1/15 |
| GB | 2353689 | | 3/2001 | | |
| GB | 2353689 | A * | 3/2001 | ..... | A01D 17/06 |

* cited by examiner

*Primary Examiner* — Terrell Matthews
(74) *Attorney, Agent, or Firm* — Jacobson Holman, PLLC.

(57) ABSTRACT

The invention refers to a screen star, in particular for a screen machine, wherein the screen star is configured essentially disc-like and can be arranged on a shaft, wherein referring to the center of the screen star at least two outside-running star fingers are provided.
The invention is characterized in that the length of the star fingers differs.

20 Claims, 9 Drawing Sheets

STAR SCREEN, IN PARTICULAR FOR A STAR SCREEN MACHINE

Figure 1:
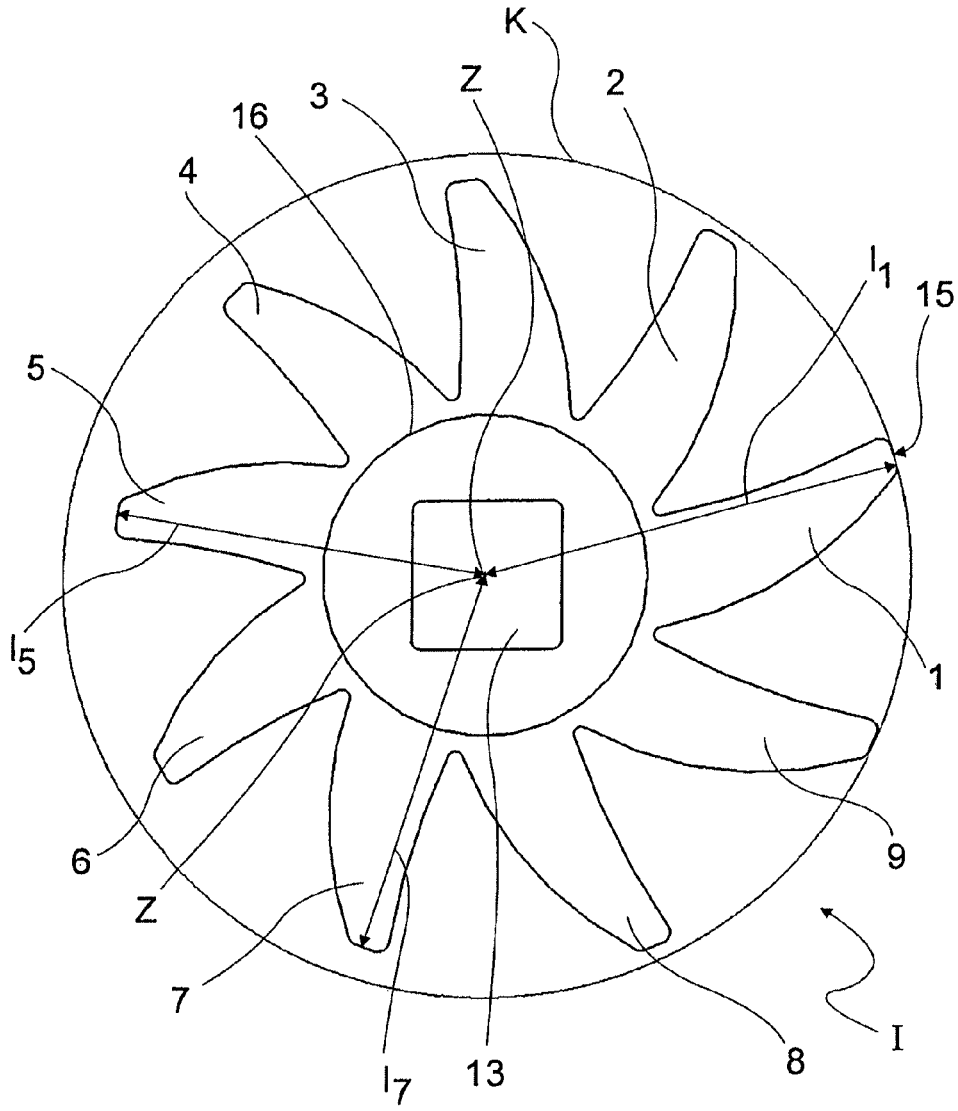

This is a national stage of PCT/EP09/008634 filed Dec. 3, 2009 and published in German, which claims the priority of German number 20 2008 016 913.5 filed Dec. 22, 2008, hereby incorporated by reference.

The invention refers to a screen star, in particular for a screen machine, wherein the screen star is designed essentially disc-like and can be arranged on a shaft, wherein coming from the center of the screen star at least two outward-extending star fingers, points or the like are provided. The invention also refers to a screen machine with a screen star of this kind.

Screen machines of this type are known. They consist of a number of screen bodies in rows one beside the other forming a surface, consisting of screen stars. These are arranged spaced apart from each other on shafts. Between the single screen stars spaces are arranged, so that the screen stars of two shafts arranged staggered to one another are able to engage in the spaces of the other screen stars. The stars of the single rows are here pivoted on axles or shafts. For the screening process the stars are set in motion and engage during the rotary motion, as already mentioned, into one another. The distance of the stars and/or their offset determine the filter or grain size of the screened material. The material usually configuring the stars is synthetic, hard rubber or the like. For harder filtered materials, such as, for example, crushed stone, also steel can be used.

Screen machines of this type can be used in many ways. They are used, for example, for screening crushed stone, shredded material, compost or also binding soil material, pebbles, sand or the like. If humid or heavy material is screened, there is the problem that the screens or the spaces between the screen stars are clogged by adhering material. Cleaning the soiled screens causes big problems in practice. For that the screen machine has to be stopped and cleaned. In the past attempts have been undertaken to solve this problem by a number of technical innovations. The stars have been provided, for example, with naps or laminas that are supposed to strip the material during the rotary motion. The effect of devices of this kind is here very limited and the wear large. Repairs caused through this and also the standstill times of the screen device cause high costs and loss of time.

A prior application by the applicant suggested providing a cleaning cylinder arranged spaced parallel to the star axles arranged in one plane. A cleaning cylinder of this kind may result in rather good cleaning, however, is quite expensive to produce and maintain.

Therefore it is an object of the invention to generate a cleaning function for screen machines of this type that is simpler, does not get soiled so often and has, in particular, a high degree of auto-cleaning.

The invention refers to the state of the art described before, and suggests a screen star, in particular for a screen machine, wherein the screen star is designed essentially disc-like and can be arranged on a shaft, wherein referring to the center of the screen star at least two star fingers extending outward are provided, and the screen star is characterized in that the length of the star fingers differs. Thus it becomes possible to get an excellent cleaning effect as through that in different distances the star fingers engage in spaces, and can remove material adhering there without any problems. Now the machine does not have to be stopped especially for cleaning, but is able to screen also humid material sufficiently, and it is not necessary to fit in certain cleaning circles. Even clamped foreign bodies, such as for example stones, are removed by the different length of the star fingers without any problems. The invention comprises at the same time several solutions. Thus it is, for example, sufficient when a single star finger of the screen star has a length differing from the other star fingers with reference to the center of the screen star. However, it is also possible that, for example two star fingers have the same length, and all other star fingers differ from this length, that means they are shorter.

According to this an advantageous development of the invention is characterized in that, with reference to the center of the screen star and its exterior circumference on the flying circle of the star fingers the screen star is configured non-symmetrically. In FIG. 1 of the description of the embodiments this becomes very clear. More or less schematically there the flying circle of the longest screen star is drawn. Thus it becomes obvious, that all other screen stars are shorter, so that a non-symmetric configuration of the screen star with reference to the center is the result. At the same time another positive effect of this configuration is that, when the screen stars are arranged in the same direction on a shaft, it begins to oscillate in a certain degree on the exterior diameter of the star fingers, leading to the effect that, first of all, the parts that have to be removed and not screened are removed better, and secondly, a positive cleaning effect occurs additionally.

However, the invention also comprises a solution according to another aspect, according to which the exterior circumference of the screen star is provided elliptically on the flying circle of the star fingers. Here, two essentially opposite star fingers have the same length, and the others are shorter. By designing this in the shape of an ellipse with reference to the flying circle of the star fingers, the result may be also a certain swinging on the exterior diameter of the star fingers of the screen machine during the use according to the purpose. However, the elliptical arrangement reduces this effect somewhat so that an undesired swinging of the entire screen does not occur here anymore.

It is also an advantage when the screen star is characterized by different lengths of each of the star fingers. Here also the achieved cleaning effect is excellent. The same goes for the next embodiment of the solution according to the invention according to which two opposing star fingers have the same length. This design also serves unambiguously for improving the cleaning effect caused by the screen motion itself, namely the rotary motion of the stars. It is not decisive here whether the two opposing shafts carry out a rotary motion in the same direction or in opposite direction.

The invention also comprises a screen star as described before characterized by an even number of star fingers. For example, the invention actually comprises providing six or twelve star fingers for the screen star. Of course, the invention also comprises a solution characterized by an odd number of star fingers.

According to the invention the star fingers are provided as tips, teeth, noses, hooks or the like designed rod-shaped or triangularly or trapezoid-shaped. The invention is not restricted here to a particular shape. However, a roughly star-shaped configuration or shape, seen from the side, has been accepted, where the star fingers are slightly half-round, and, as it will be described later on, their tips are preferably flattened.

As already mentioned, the invention is not restricted neither to an even nor an odd number of star fingers. Thus, the invention also comprises the configuration of the screen star with seven star fingers, nine star fingers or even with twelve star fingers.

A preferred embodiment of the invention is characterized in that the star fingers have on their outer ends flattenings or smoothings. These flattenings or smoothings serve for preventing clogging, for example by squeezing foreign bodies. Also the wear is minimized by a flattened design of the outer end of the star finger.

In order to increase the cleaning effect further, at least one of the star fingers has on its end or on the flattening a lug. This lug is, for example, designed as nose, as tip, as peg, as elevation or the like. It is important, that this lug preferably does not take the entire surface of the flattening, but only a part, so that this lug serves actually for improving the cleaning effect.

Another modification of the invention provides that two lugs are arranged on roughly opposing star fingers, preferably the longest ones. This is completely sufficient as the lugs remain quite without effect when they are arranged on roughly shorter star fingers. However, this does not exclude that they are provided also there in order to loosen, if necessary, clogged material, that then can be transported by the longest star finger with its lug out of the space between two screen stars.

According to another aspect, the invention comprises a design where the screen star is formed of one piece of material as well as a design where the star fingers extend from a flange provided in the interior of the screen star outward. The screen star can be provided here in one piece together with flange and the star fingers. However, it is also possible, to mould or attach the star fingers on the flange.

Furthermore, the invention suggests providing an opening serving for attaching the screen star on a shaft or the like in the before described flange. This opening is here adapted to the shape of the flange, and can be accordingly designed circularly, oval, triangularly, squarely, rectangular, hexagonally or polygonal. Depending on the shape of the shaft used, also the opening in the flange of the screen star is manufactured correspondingly.

It is a particular advantage when the opening is designed correspondingly for receiving a shaft designed as profile shaft, in order to receive the hollow shaft in particular designed as profiled shaft positive and/or non-positive interlocking. These profiled shafts as hollow shafts, designed in particular hexagonally, are known for special purposes, and therefore serve also excellently for receiving screen stars according to the invention.

Furthermore, it is a particular advantage, when the opening, with reference to one of the star fingers, for example the longest star finger, is arranged shifted or twisted, in particular to make an offset of the star fingers around an angle of 15° to 90°, preferably 30°, possible. Thus, the star fingers can be arranged, seen, for example, with reference to the longest star finger, in a sort of spiral on the shaft. Furthermore, this has the advantage that the cleaning effect is improved further, and the effect is, in particular, that swinging of the entire screen device is avoided completely by this configuration, as this results in a certain mass compensation.

It is provided, according to the invention, that the screen star or the star fingers are formed, at least partly of a rubber-like or elastic material. It has proved here convenient to chose the material in such a way, that it is adapted to the conditions of the respective screen product. Thus, it has proved to be an excellent solution using a softer rubber material than it was used so far with compost soil. However, this does not exclude that also harder material is used, for example for screening crushed stone. The before described configurations of solutions of the screen star according to the invention can also be used for all other materials that are suited for manufacturing a screen star.

Another advantageous embodiment of the invention is characterized in that the screen star has in its center at least a reinforcement of sturdy material, such as for example metal, fiber reinforced synthetic material or similar stable material. To this sturdy material, for example to a flange, then the star fingers are attached. This has the advantage that the wear, that may occur by the transmission of power, for example on the shaft, if material is used that is not sufficiently sturdy, is avoided.

According to this, a modification of the invention is also characterized in that the before described flange of the screen star is formed of metal, and the star fingers are scorched or vulcanized on, and/or sprayed on, and/or burned on or cast on at this flange. Thus a stable connection between the flange and the shaft is achieved that is able to transmit sufficient forces to guarantee also a very fast screen process. On the other hand, thus the effect is achieved that the star fingers can be produced of a softer material, for example rubber, that influences in any case the screening effect for certain products positively.

Furthermore, according to the invention in the flange at least one, preferably long-hole cleaning boring is provided. Thus, certain material particles, that cannot escape from the space between the single screen stars, then can be removed through this cleaning boring. Furthermore, the offset of the single screen stars on the shaft and the cleaning borings result in an additional cleaning effect, so that by this measurement clogging can be avoided almost completely.

Another aspect of the solution according to the invention is characterized in that, at least on one side of the flattenings forming the thickness, a chamfer is provided breaking the edge from the flattening to the side forming the thickness of the star finger. This measurement also serves, on the one hand, for reducing the wear, and, on the other hand, also for another improvement of the cleaning effect, as by the chamfer it becomes possible to improve the cleaning effect further. Furthermore it is an advantage when the thickness or the size of the flange corresponds roughly with the thickness of the star finger. If necessary, it may be enough to provide a space in the range of 1/10 mm to max. 1 mm that makes gliding of the star fingers across the flange possible.

The invention also refers to a screen machine, in particular star screen machine, comprising a number of screen stars arranged in rows one beside the other in one plane, pivoted on axles, shafts or the like, engaging in one another with a screen star as described before. It is an advantage here, when, according to one embodiment of the screen machine described before, the stars engage into one another staggered in such a way that the star tips of the screen stars arranged on a first shaft engage in the spaces between the screen stars of a second shaft. This increases tremendously the cleaning effect and in particular the screen effect. The distance of the shafts to one another or the distance of the star tips from the flanges of the screen stars determines here the size of the particles of the screened material. It is also an advantage when the shafts, on which the screen stars are arranged, are designed shifting to each other so that, because of different screening materials, the distance can be selected accordingly.

An advantageous development of the screen machine according to the invention is characterized in that the shafts are designed as profiled shafts that then have on their outsides in particular six trapezoidal segments between which semi-circular or half-round recesses extend. Profiled shafts of this type, that are configured in particular as hollow bodies, are characterized by a low weight, and are in addition very stable, and offer a very advantageous power transmission from the shaft to the screen star. Here it is furthermore an advantage if the shafts configured as profiled shafts have on their inside also trapezoidal shaft segments.

As already mentioned it is an advantage when the screen machine is characterized in that the screen stars provided on a shaft are arranged twisted towards each other so that because of the offset a spiral-like configured screen star shaft occurs. Two shafts arranged in this way then are advantageously angled towards each other in such a way, that the longest screen stars or star fingers are just able to pass each other glidingly with sufficient distance to each other on the flange of the screen star.

According to this the invention is characterized in that at least two shafts are spaced apart in such a way, that each time the longest star finger is able to pass glidingly from the flange or lug with little distance between 0.5 mm to 3.0 mm during a rotary motion, in particular during a revolution.

The invention is characterized in that the at least two shafts can be driven with different rotational speed. For that it may be necessary to provide appropriate transmissions and/or drives on the screen machine. No matter, whether the single shafts are driven by a driving machine and the single shafts are geared down differently by one or several transmissions, or whether for each shaft a single drive is provided effecting the rotary motion, it is possible according to the invention to transfer different rotational speeds to the single shafts carrying the screen stars.

In the following the invention is described by embodiments.

Figure 7:
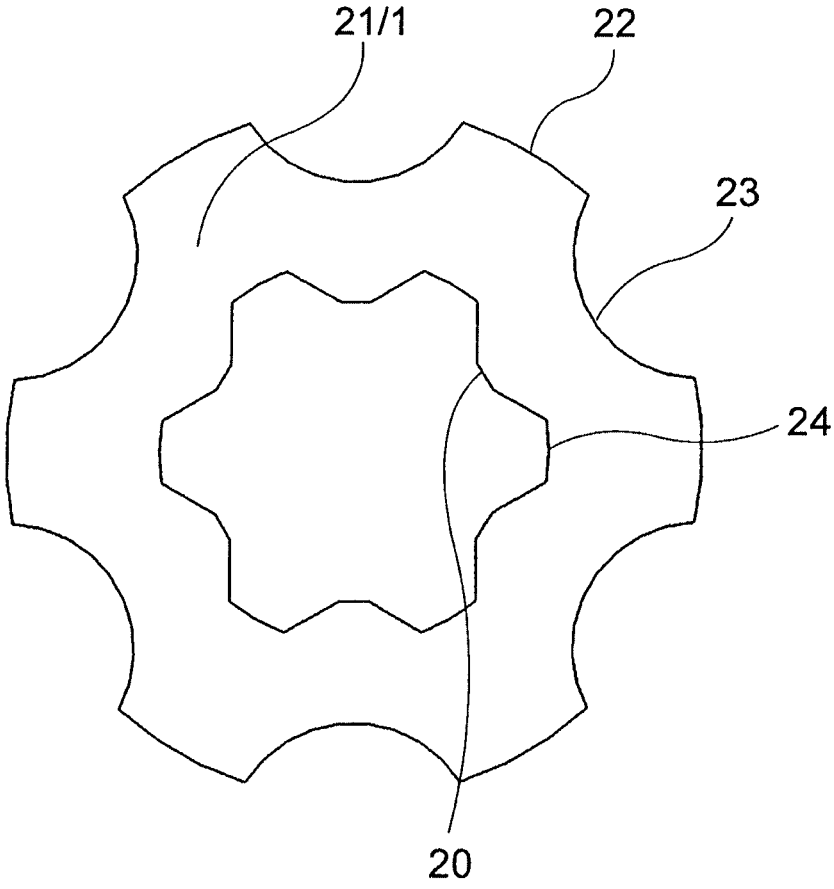
Figure 8:
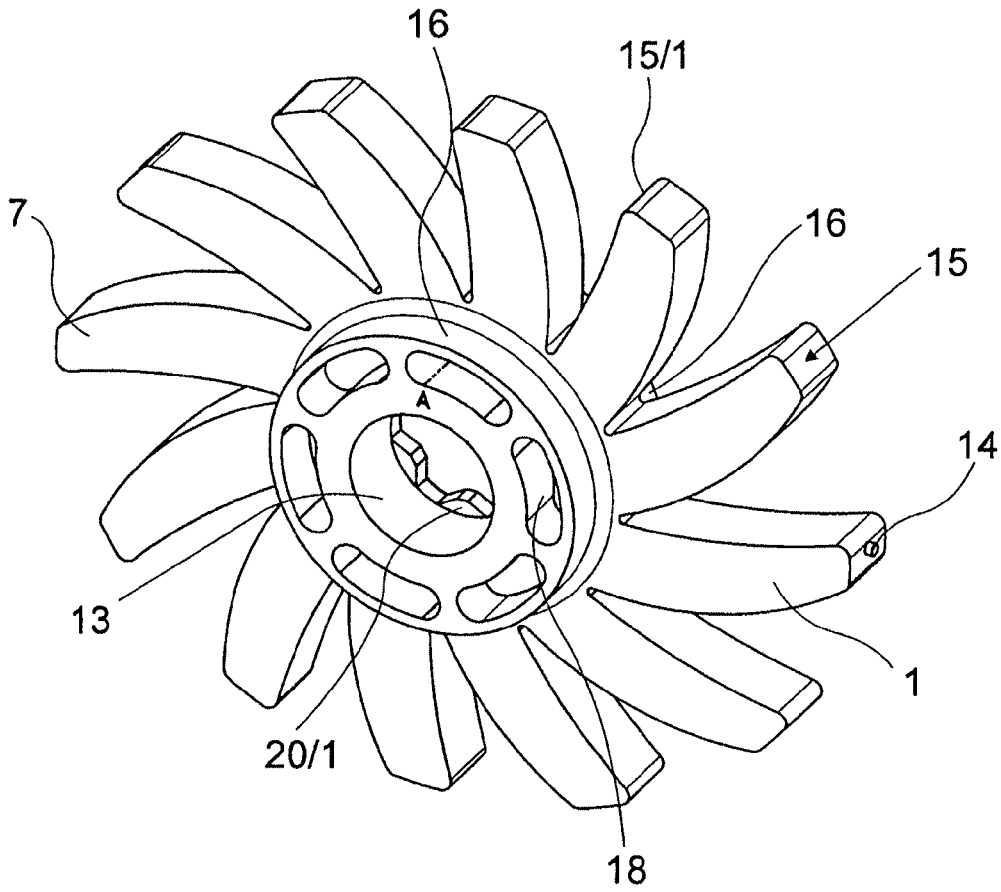
Figure 9:
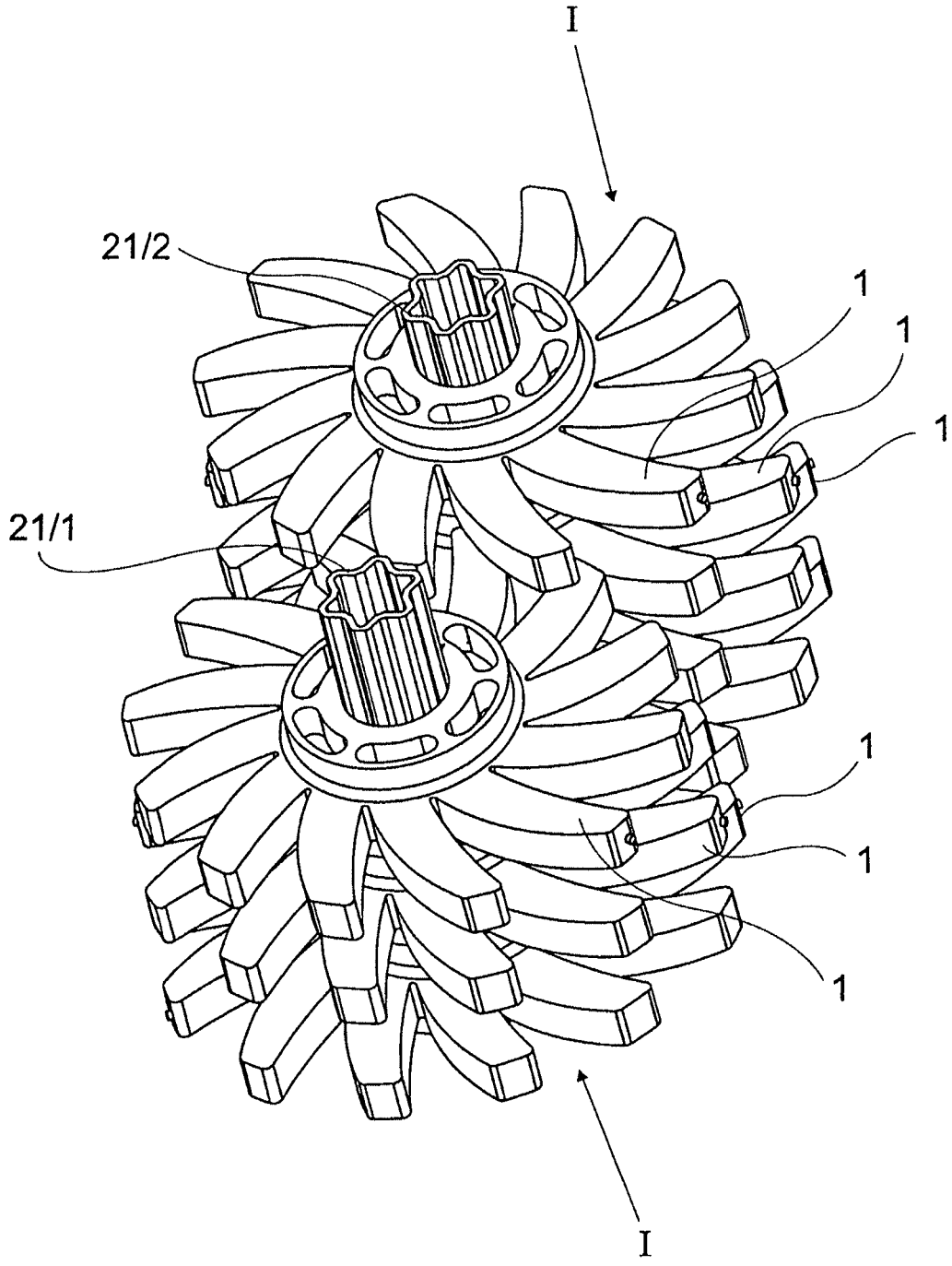

In the figures:

FIGS. 1 to 6 different embodiments of screen stars according to the invention;

FIG. 7 a hollow shaft for a screen machine according to the invention in a side view;

FIG. 8 three-dimensional depicton of a screen star according to the invention;

FIG. 9 arrangement of screen stars according to the invention on two shafts spaced apart.

FIG. 1 shows a first embodiment of a screen star I according to the invention. The star fingers are here indicated by the reference numbers 1 to 9 in this embodiment. As it can be seen, the star fingers 1 to 9 have different lengths. This is indicated by reference numbers $I_1$, $I_5$ and $I_7$ and the appropriate double arrows. The length is measured here with reference to a center Z of the screen star. In the center of the screen star I also an opening 13 is provided configured essentially squarely in this embodiment. The square configuration is meant, for example, for equipping a square shaft with a number of screen stars I arranged then one beside the other in the longitudinal extension of the shaft.

In order to make a certain distance of the screen stars I to one another possible, for that a flange 16, here indicated only by a line, is provided. This flange 16 has, as it can be seen in depictions later on, a certain thickness, in particular a thickness corresponding with the thickness of the star fingers 1 to 9, to enable a mutually engaging arrangement of screen stars I on two shafts arranged spaced apart. The screen star is referred to schematically only by reference number I, what is indicated with an arrow on the right hand side besides the depiction in FIG. 1. Reference number K indicates the exterior circumference of the longest star finger 1. By means of the circumference K, chosen only for depicting, it can be seen clearly that the single star fingers 1 to 9 have different lengths. Furthermore, it can be seen that the single star fingers 1 to 9 have also a flattening 15 that is preferably rounded or chamfered on their corners. This flattening serves, as already described before, for reducing the wear, and to improve, in particular, also the cleaning effect. According to this, in FIG. 1 the non-symmetric configuration of the star fingers 1 to 9 is shown with reference to the circumference of the flying circle.

Figure 2:
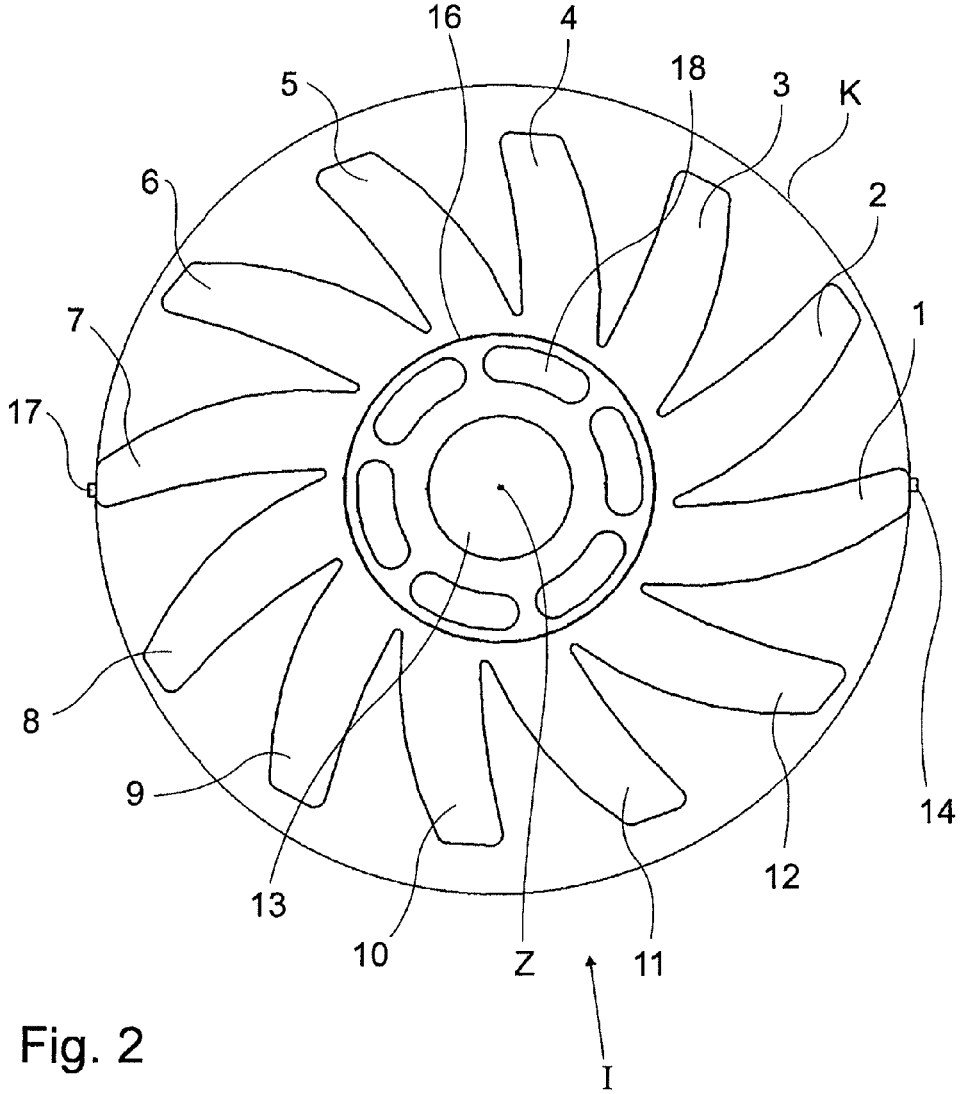

FIG. 2 shows a second embodiment of the screen star I according to the invention. In contrast to FIG. 1. there are here two essentially opposing star fingers 1 and 7 with the same length. The other star fingers are again shortened compared to that, so that in the exterior circumference, as it can be seen, not a circle but an ellipse occurs. This is the elliptical design of the screen star according to the invention. All other reference numbers are used again in the same way. In addition to the configuration shown in FIG. 1, in FIG. 2 a lug 14 is provided on the star finger 1 and a lug 17 on the star finger 7. This is arranged on the flattening 15 and is located outside the circumference K of the longest star fingers 1 and 7, respectively. This improves the cleaning effect during the gliding passing of the longest star fingers with the lugs 14 and 17 on the flange 16 of the screen star I, not shown in detail here, on another shaft provided spaced apart parallel. Flange 16 has in this embodiment cleaning borings 18 designed like a long hole. These cleaning borings 18 improve the cleaning effect as it becomes possible through them to remove material, that may adhere, via these borings. This may be very small particles that otherwise could lead, when they are collected on the flange or in the spaces of the star fingers, to a clogging of the screen. In the state of the art this was often the case, and is now essentially avoided by the configuration chosen according to the invention. The opening 13 in the configuration of FIG. 2 is chosen circular, so that this screen star can be put on a circular shaft. This can be done, for example, also in the form of groove and tongue connections or by shrinking-on, in order to reach optimal power transmission from the not-shown shaft to the screen star.

Figure 3:
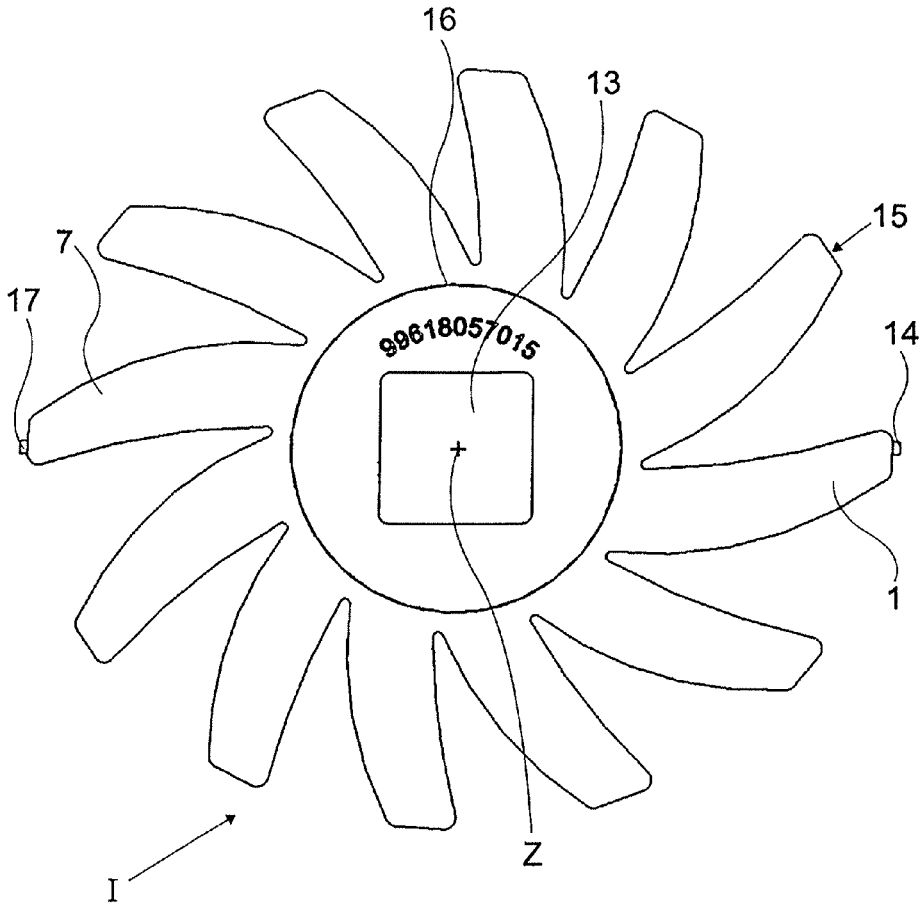

FIG. 3 also shows an elliptic design analogue to FIG. 2, however, this modification differs by an again square opening 13. All other reference numbers are used again in the same way.

Figure 4:
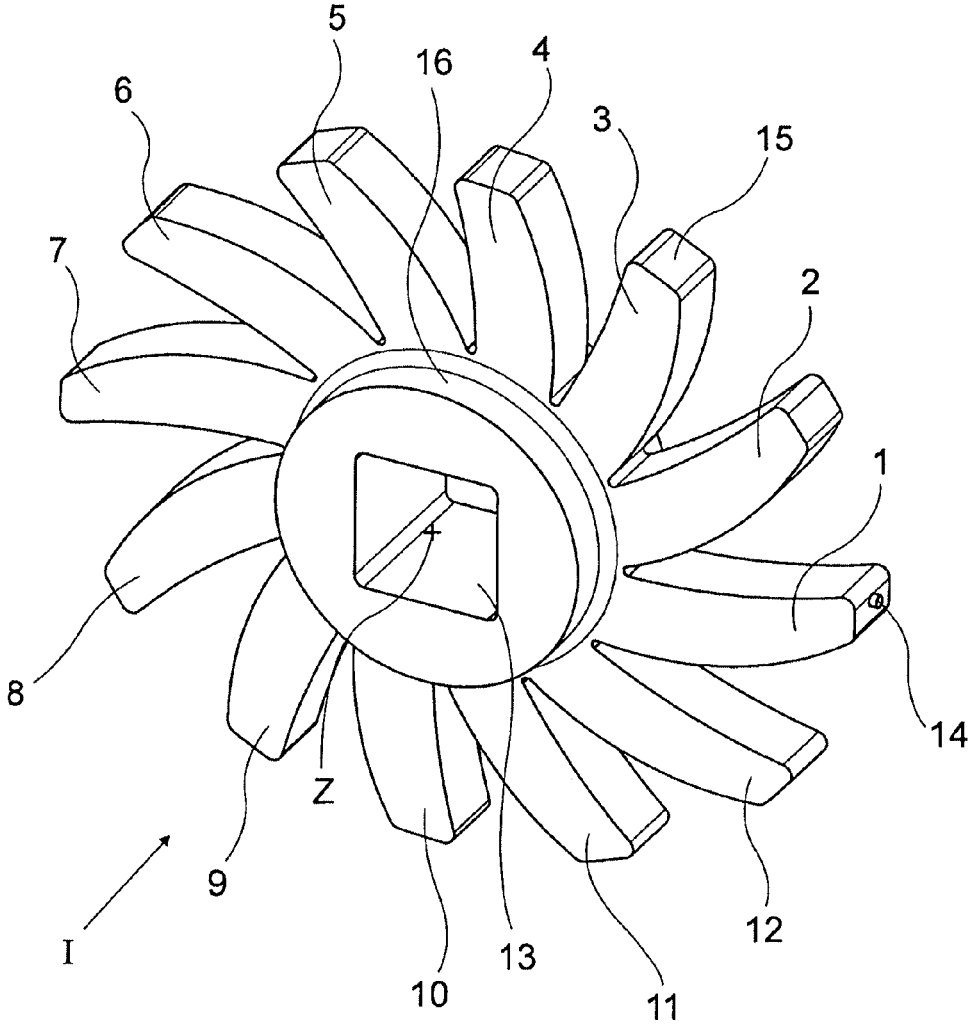
Figure 5:
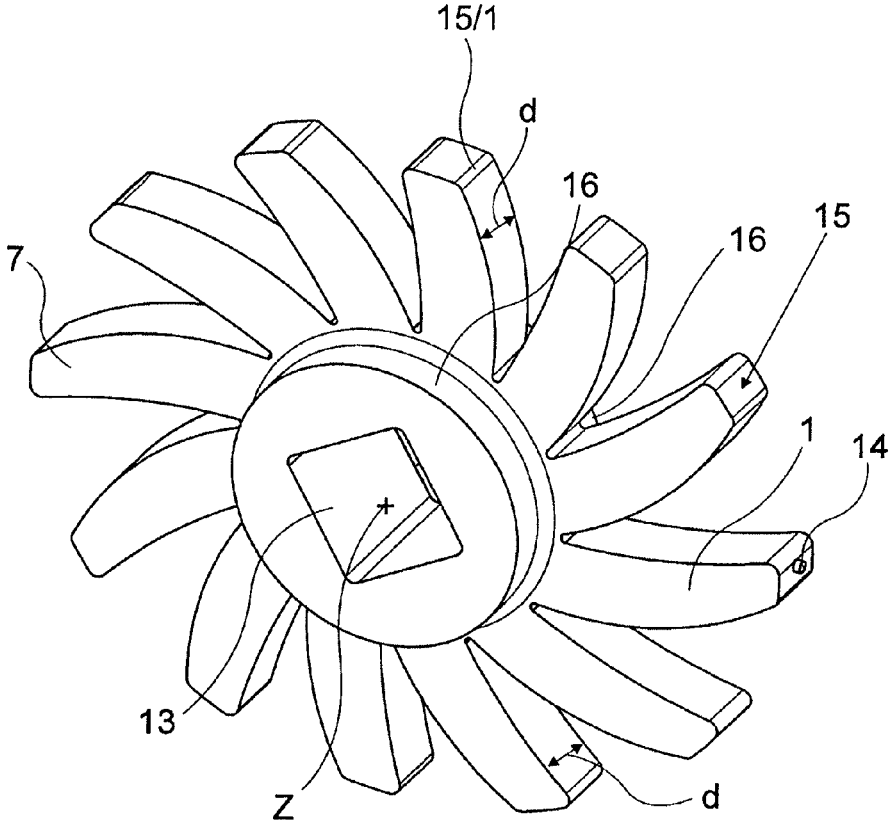

FIG. 4 shows a three-dimensional depiction of the screen star as it has already been presented in the previous FIGS. 2 and 3. The screen star I has here a flange 16 on both sides that corresponds essentially with the thickness or the size of the star fingers 1 to 12. The opening 13 is here again provided with slight roundings or flattenings on its corners. The configuration in the depiction is also elliptic, however, compared with FIG. 5, shown in the following, makes it visible that it is possible arranging the opening 13 staggered or twisted with reference to the first star finger 1. This makes a spiral arrangement, shown later, of the screen stars I on the shaft, not yet shown here. In FIG. 5 also the chamfer 15/1 on the sides of the flattening 15 can be seen that eventually break the edge to the thickness or depth of the star fingers, and thus effect a reduction of the wear and/or an improvement of the screen effect.

Figure 6:
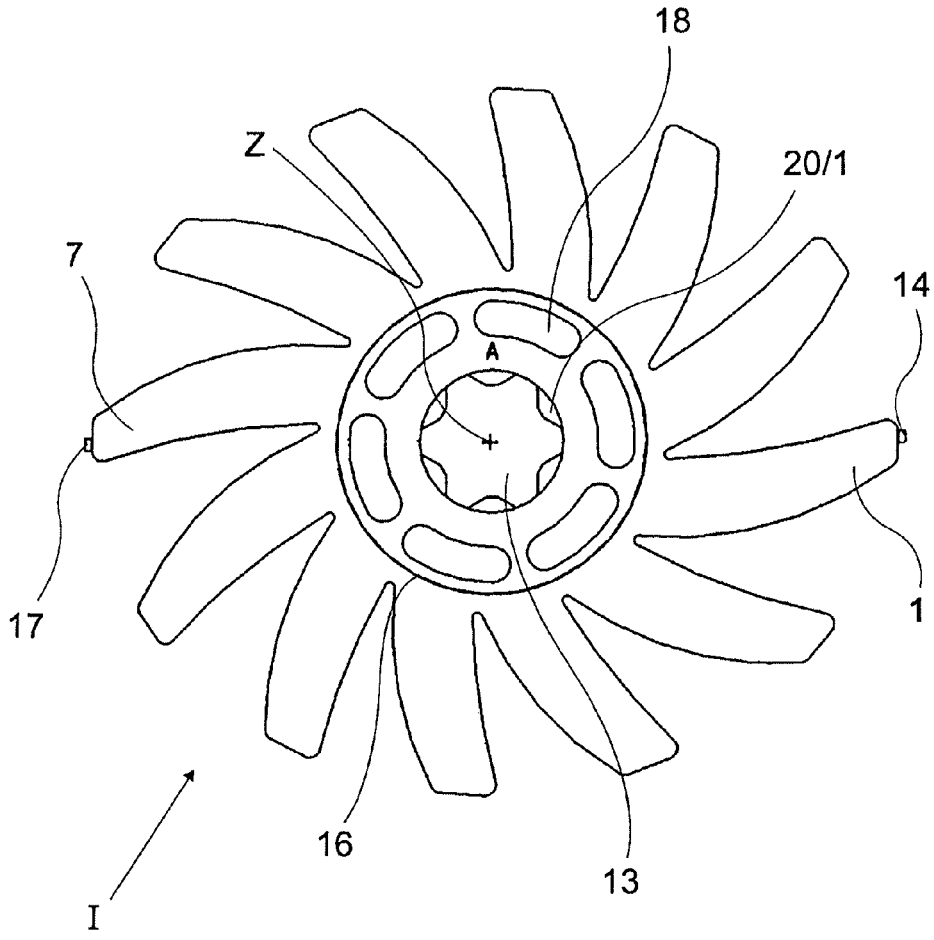

FIG. 6 shows another embodiment that differs eventually only by the design of the flange from the modifications described so far. The flange 16 is in this embodiment circular, the opening 13 being not configured for receiving a profiled shaft not shown. It is indicated here, that in the flange corresponding to the trapezoidal configured shaft segments of the not-shown shaft, also trapezoidal designed elevations 20/1 are provided.

FIG. 7 shows the side view of such a profiled shaft designed as hollow body, and that has, in particular on its outside, six trapezoidal segments 22. These trapezoidal segments 22 are between semi-circular or half-round recesses 23 on the outside. On the inside the already mentioned trapezoidal designed shaft segments 20 are provided extending between recesses 24 that are also configured essentially trapezoidal.

FIG. 8 shows a three-dimensional depiction of the modification of the star finger according to the invention already presented in FIG. 6, from another perspective.

FIG. 9 eventually shows schematically the embodiment of a screen machine, in particular star screen machine with a screen star I according to the invention. Two shafts 21/1 and 21/2 carrying the screen stars I are shown only schematically. Because of the staggered arrangement of the screen stars I on the shafts 21/1 and 21/2, respectively, the result is a spiral arrangement that becomes clear by indicating the respectively longest star fingers 1. These are here arranged staggered essentially each time by a certain angle on the shaft, so that the already several times mentioned, advantageous configuration of the arrangement of the screen stars I according to the invention is the result. The shafts 21/1 and 21/2 can be supported here in such a way, that their distance to one another can change depending on the material to be screened. Furthermore it is possible to transfer a rotary motion in the same direction on the respective shafts as also a rotary motion in opposite direction. For that, the screen machine has appropriate driving aggregates and/or transfer elements such as, for example, transmissions or the like. A star screen machine according to the invention has a number of the shown shafts in an opening forming the screen surface.

The dimensions in the figures are preferred modifications. However, the invention is not restricted to these dimensions. In the description and the claims characteristics rather are mentioned that claim a broader protection for the invention.

The invention has been described before by means of examples. The claims filed now and together with the application later on are attempted formulations without prejudice for obtaining a broader protection.

References in the sub-claims refer to the further embodiment of the subject matter of the main claim by the characteristics of the respective sub-claim. These are, however, not to be understood as a waiver of independent subjective protection for the characteristics of the referred sub-claims.

Characteristics so far only disclosed in the description, can be claimed in the course of proceedings as being of essential importance for the invention, for example to distinguish from the state of the art.

The invention claimed is:

1. A screen star, in particular for a screen machine, wherein the screen star is designed essentially disc-like, and can be arranged on a shaft, wherein referring to the center of the screen star at least two star fingers extending outward are provided, the length of the star fingers differs, length or each time two opposing star fingers have the same length, characterized in that at least one of the star fingers has on its tip or flattening a catch, wherein the catch is a nose, a tip, a pin, or an elevation.

2. The screen star according to claim 1, characterized in that with reference to the center of the screen star and its outer circumference on the flying circle of the star fingers the screen star is non-symmetric, respectively elliptically.

3. The screen star according to claim 1, characterized by an even or an odd number of star fingers, in particular seven star fingers, nine fingers twelve star fingers.

4. The screen star according to claim 1, characterized in that the star fingers are provided as tips, teeth, noses, hooks in the shape of a rod, triangle or trapezoid or the star fingers have on their outer ends flattenings or smoothings.

5. The screen star according to claim 1, characterized in that at least one of the star fingers has on its tip or flattening a catch and two catches are arranged on roughly opposing, preferably the longest star fingers.

6. The screen star according to claim 1, characterized in that the star fingers extend from a flange provided in the interior of the screen star outward, wherein the flange is provided on both sides of the star fingers and in in the flange an opening is provided serving for attaching the screen star to a shaft.

7. The screen star according to claim 1, characterized in that a flange and in the flange an opening is provided and the opening in the flange is designed circularly, oval, triangularly, squarely, hexagonally or polygonal, or the opening for receiving a shaft configured as a profiled shaft is designed correspondingly for receiving the profiled shaft, designed in particular as hollow shaft, positive and/or non-positive locking.

8. The screen star according to claim 1, characterized in that a flange and in the flange an opening is provided and the opening is arranged shifted or twisted with respect to one of the star fingers, in particular to make a lag of the star fingers around an angle of 15 to 90 degrees possible.

9. The screen star according to claim 1, characterized in that the screen star or the star fingers consist, at least partly, of a rubber-like or elastic material and/or the screen star has in its middle at least a reinforcement of sturdy material.

10. The screen star according to claim 1, characterized in that a flange is provided in the interior of the screen star and the flange is formed of metal, and the star fingers are scorched or vulcanized on, and/or sprayed or burned or cast on this flange.

11. The screen star according to claim 1, characterized in that a flange is provided in the interior of the screen star and in the flange at least one cleaning boring configured as long hole is provided.

12. The screen star according to claim 1, characterized in that flattenings at the star fingers are provided and at least on one side of the flattenings forming the thickness a phase is provided breaking the edge from the flattening to the side forming the thickness of the star finger.

13. The screen star according to claim 1, characterized in that a flange is provided in the interior of the screen star and the thickness or the size of the flange corresponds roughly with the thickness of the star fingers.

14. The screen machine, in particular star screen machine, comprising a number of screen stars arranged in rows one beside the other in one plane, and supported pivoted on shafts, axles or the like, engaging with one another, according to claim 1.

15. The screen machine according to claim 14, characterized in that the screen stars are engaged shifted to one another in such a way that the tips of the stars of the star screens arranged on a first shaft engage in the spaces between the screen stars of a second shaft.

16. The screen machine according to claim 14, characterized in that a different distance of the shafts from one another is provided.

17. The screen machine according to claim 14, characterized in that the shafts are configured as profiled shafts with in particular six trapezoidal segments on their outsides, between which semicircular or half-round recesses extend or the shafts configured as profiled shafts have inside trapezoidal shaft sections.

18. The screen machine according to claim 14, characterized in that the screen stars provided on a shaft are arranged twisted to one another on the shaft so that, because of the lag, a spiral-shaped screen star shaft results, in particular at least two of the shafts are arranged spaced apart from each other in such a way that each time the longest star finger from the flange to the catch is able to glide past with little distance between 0.5 to 3 mm during the rotational motion.

19. The screen machine according to claim 14, characterized in that the at least two shafts can be driven with different rotational speed, wherein preferably a rotational motion of the at least two shafts in the same direction or in opposite directions is provided.

20. The screen star according to claim 9, characterized in that the sturdy material is metal or reinforced synthetic material.

* * * * *